US009335138B2

(12) United States Patent
Nixon et al.

(10) Patent No.: US 9,335,138 B2
(45) Date of Patent: May 10, 2016

(54) COMBINATION HAND TOOL FOR MOLDING AND TRIMMING BULLETS, AND CRIMPING A RIMFIRE CASE TO A BULLET TO MAKE A RIMFIRE CARTRIDGE

(71) Applicants: Brian Nixon, Grand Junction, CO (US); Dennis Schultz, Montrose, CO (US)

(72) Inventors: Brian Nixon, Grand Junction, CO (US); Dennis Schultz, Montrose, CO (US)

( * ) Notice: Subject to any disclaimer, the term of this patent is extended or adjusted under 35 U.S.C. 154(b) by 0 days.

(21) Appl. No.: 14/690,369

(22) Filed: Apr. 17, 2015

(65) Prior Publication Data

US 2016/0025471 A1 Jan. 28, 2016

Related U.S. Application Data

(60) Provisional application No. 61/980,733, filed on Apr. 17, 2014.

(51) Int. Cl.

| | |
|---|---|
| ***F42B 33/02*** | (2006.01) |
| ***F42B 33/00*** | (2006.01) |
| ***B22C 9/06*** | (2006.01) |
| ***B22C 9/22*** | (2006.01) |
| ***B22D 25/00*** | (2006.01) |

(52) U.S. Cl.

CPC ..... *F42B 33/005* (2013.01); *B22C 9/06* (2013.01); *B22C 9/22* (2013.01); *B22D 25/00* (2013.01); *F42B 33/001* (2013.01)

(58) Field of Classification Search

CPC ..... F42B 33/005; F42B 33/001; B22C 9/06; B22C 9/22; B22D 25/00

USPC ..... 86/18, 25, 26, 24; 164/263, 264; 249/108

See application file for complete search history.

(56) References Cited

U.S. PATENT DOCUMENTS

| | | | | | |
|---|---|---|---|---|---|
| 30,054 | A * | 9/1860 | Evans | B22D 25/04 | 164/264 |
| 30,533 | A * | 10/1860 | Evans | B28B 7/168 | 102/526 |
| 319,304 | A * | 6/1885 | Oldham | B22D 25/04 | 164/264 |
| 340,171 | A * | 4/1886 | Trimmer | B22D 25/04 | 164/264 |
| 354,422 | A * | 12/1886 | Jewett | B29C 45/26 | 164/264 |
| 413,939 | A * | 10/1889 | Harris | B22D 25/04 | 164/264 |
| 598,355 | A * | 2/1898 | Borcur | B22D 25/04 | 164/264 |

(Continued)

*Primary Examiner* — Michelle R Clement

(74) *Attorney, Agent, or Firm* — Russ Weinzimmer & Associates, P.C.

(57) ABSTRACT

A rimfire reloading tool for making rimfire cartridges is disclosed. The tool includes first and second handles connected by a hinge. A bullet mold is formed by two bullet mold heads located opposite each other on the first and second handles. The bullet mold is formed when the first and second handles are brought together. First and second clipping portions are located opposite of each other on the first and second handles and clip excess metal from the formed bullet. First and second crimping portions are located opposite each other and crimp a case onto the formed bullet when the first and second handles are brought together, thereby providing a rimfire cartridge.

20 Claims, 3 Drawing Sheets

(56) References Cited

U.S. PATENT DOCUMENTS 705,146 A * 7/1902 Richter ..... B22C 9/06 249/108
748,460 A * 12/1903 Anderson, Jr. ..... B22D 25/04 164/264
904,273 A * 11/1908 Mundt ..... B22C 9/06 164/264
936,475 A * 10/1909 Putney ..... B29C 45/26 249/142
1,763,977 A * 6/1930 McNeely ..... B22C 9/22 249/108
2,114,015 A * 4/1938 Cramer ..... B22C 9/22 164/264
3,126,594 A * 3/1964 Galloway ..... B22C 9/22 164/264
3,581,807 A * 6/1971 Taylor ..... B22D 31/00 164/264
3,718,310 A * 2/1973 Cerone ..... B22C 9/06 164/264
3,745,873 A * 7/1973 Lee ..... B22C 9/22 164/264
3,749,351 A * 7/1973 Lee ..... B22C 9/06 249/170
3,870,272 A * 3/1975 Jackman ..... B22C 9/22 249/122
3,898,908 A * 8/1975 Isenhower ..... F42B 33/06 269/239
4,089,501 A * 5/1978 Zahoran ..... B22C 9/22 164/262
4,097,018 A * 6/1978 O'Herien ..... B22C 9/06 164/264
4,342,141 A * 8/1982 Graham ..... F42B 12/74 86/1.1
4,393,744 A * 7/1983 Lee ..... F42B 33/04 86/25
4,425,833 A * 1/1984 Purdie ..... F42B 33/002 86/26
4,526,084 A * 7/1985 David ..... F42B 33/04 86/24
4,566,366 A * 1/1986 Lee ..... F42B 33/04 86/24
4,624,297 A * 11/1986 Clausen ..... B22D 17/2236 164/262
4,687,045 A * 8/1987 Roller ..... B22D 25/00 164/262
4,838,339 A * 6/1989 French ..... B22D 25/02 164/264
5,884,540 A * 3/1999 Mo ..... B25B 7/04 81/423
6,260,463 B1 * 7/2001 Brand ..... F42B 33/04 86/24
6,502,625 B2 * 1/2003 Pullum ..... B22D 25/02 164/264
7,350,393 B2 * 4/2008 Li ..... B25B 7/04 29/751
7,681,481 B1 * 3/2010 Buckley ..... F42B 33/005 86/26
8,915,173 B2 * 12/2014 Clinton ..... 81/353
D741,675 S * 10/2015 Gibson, Jr. ..... D8/52
2002/0117287 A1 * 8/2002 Pullum ..... B22D 25/02 164/262
2013/0263723 A1 * 10/2013 Duneman ..... F42B 33/004 86/40

* cited by examiner

COMBINATION HAND TOOL FOR MOLDING AND TRIMMING BULLETS, AND CRIMPING A RIMFIRE CASE TO A BULLET TO MAKE A RIMFIRE CARTRIDGE

CROSS-REFERENCE TO RELATED APPLICATIONS

This application claims priority to U.S. Provisional patent application Ser. No. 61/980,733, filed Apr. 17, 2014, which is incorporated herein by reference in its entirety.

FIELD OF THE INVENTION

The present invention relates generally to ammunition reloading (also called handloading), and more particularly reloading of rimfire cartridges.

BACKGROUND OF THE INVENTION

Firearms use bullets that are formed by melting a soft metal, such as lead, and forming it in a casting mold. The mold forms the bullet into a desired shape but also often leaves some excess material attached to the formed bullet. The excess material is removed and the bullet is attached to a case. The case contains an explosive charge and is crimped around a rear portion of the bullet and the rest of the bullet beyond the case remains exposed. Current rimfire cases only accept bullets having a heel or flat surface at the bottom of the bullet. Currently, multiple tools are used to reload or handload cast heeled bullets into a case. Further, if one wants to reload rimfire ammunition, expensive custom molds are needed. Also, crimping tools used for reloading centerfire cartidges would put pressure on the rim of the case, which can prematurely detonate the rimfire case.

SUMMARY OF THE INVENTION

One general aspect of the invention is a rimfire reloading tool including: first and second handles connected by a hinge; a bullet mold having a first mold head located on the first handle and a second bullet mold head located on the second handle that form the heeled bullet mold when brought in contact with each other; a first clipping portion located on the first handle and a second clipping portion located on the second handle that are brought together when the first handle and second handle are in a closed position; and a first crimping portion located on the first handle and a second crimping portion located on the second handle that are brought together when the first handle and the second handle are in a closed position.

In an embodiment, the bullet mold is configured to form a .22 caliber bullet. In an embodiment, a spinner tool is located in one of the first and second handles, the spinner tool having an aperture configured to receive a case containing priming compound and sufficiently dimensioned to allow the case to rotate within the aperture. In an embodiment, the spinner tool includes a plurality of apertures configured to receive a plurality of cases containing priming compound and sufficiently dimensioned to allow the cases to rotate within the apertures. In an embodiment, the bullet mold is formed above the hinge. In an embodiment, a plurality of bullet molds is formed between the first and second handles. In an embodiment, the plurality of bullet molds is located below the hinge. In an embodiment, the bullet mold is dimensioned to form a raised rim on a heeled bullet on which a case is crimped. In an embodiment, the bullet mold is dimensioned to form an indented lip and a heeled portion, the indented lip and heeled portion disposed on opposite sides of the raised rim. In an embodiment, the first bullet mold head and the second bullet mold head are constructed of material that can be heated above a temperature at which lead melts while remaining rigid. In an embodiment, the first and second handles include a heat-absorbing material.

Another general aspect of the invention is a rimfire reloading tool including first and second handles connected by a hinge at the top of the first and second handles; a bullet mold having a first mold head located on the first handle and a second bullet mold head located on the second handle that form the heeled bullet mold when brought in contact with each other; a first clipping portion located on the first handle and a second clipping portion located on the second handle that are brought together when the first handle and second handle are in a closed position; and a first crimping portion located on the first handle and a second crimping portion located on the second handle that are brought together when the first handle and the second handle are in a closed position. In an embodiment, the bullet mold is configured to form a .22 caliber bullet. In an embodiment, a spinner tool is located in one of the first and second handles, the spinner tool having an aperture configured to receive a case containing priming compound and sufficiently dimensioned to allow the case to rotate within the aperture. In an embodiment, the spinner tool includes a plurality of apertures configured to receive a plurality of cases containing priming compound and sufficiently dimensioned to allow the cases to rotate within the apertures. In an embodiment, a plurality of bullet molds is formed between the first and second handles.

In an embodiment, the bullet mold is dimensioned to form a raised rim on a heeled bullet on which a case is crimped. In an embodiment, the bullet mold is dimensioned to form an indented lip and a heeled portion, the indented lip and heeled portion disposed on opposite sides of the raised rim.

In yet another aspect, the present invention provides a method of manufacturing a rimfire cartridge, including: providing a hand tool having first and second handles connected by a hinge, the first handle having a first bullet mold head, a first clipping portion, and a first crimping portion; bringing the first and second handles together to form a bullet mold; pouring molten lead into the bullet mold; opening the handles when the molten lead has cooled and solidified and formed a heeled bullet; removing the heeled bullet from the bullet mold; placing the heeled bullet in between the first clipping portion and the second clipping portion and bringing the first handle and second handle together and removing excess lead from a heeled portion of the heeled bullet; placing the heeled portion of the heeled bullet into a case containing priming compound and gunpowder; placing the case containing the heeled bullet in between the first crimping portion and the second crimping portion and bringing the handles together to crimp the case onto the heeled bullet. In an embodiment, an additional step includes placing the case in a spinner tool located in the second handle and rotating it to disburse priming compound on the inner surface of the case before inserting the heeled bullet into the case.

BRIEF DESCRIPTION OF THE DRAWINGS

Many additional features and advantages of the present invention will become apparent to those skilled in the art upon reading the following detailed description when considered in conjunction with the drawings.

DETAILED DESCRIPTION OF THE DRAWINGS

Figure 1:
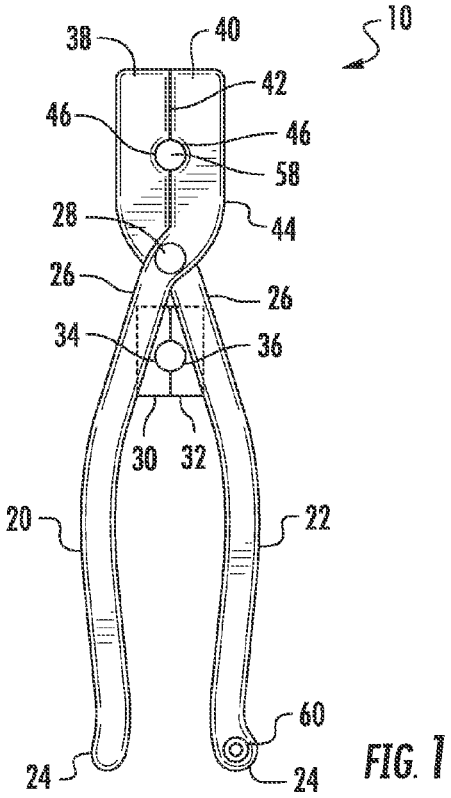
FIG. 1 is an elevation view of a rimfire reloading tool for forming heeled bullets.
Figure 2:
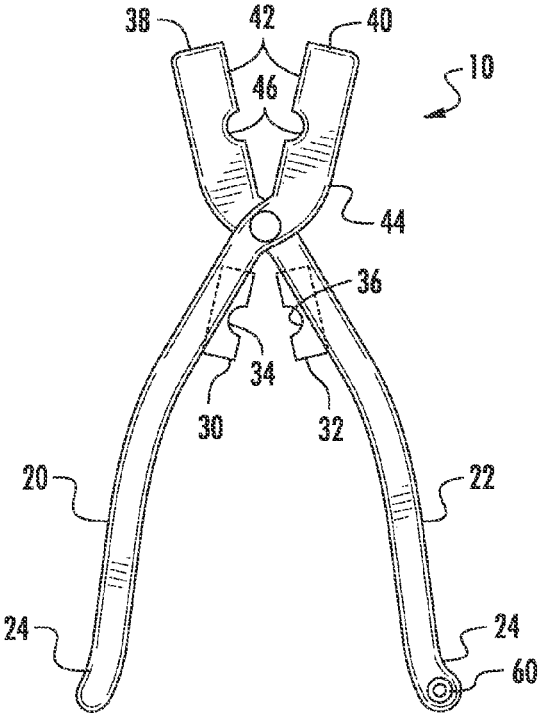
FIG. 2 is an elevation view of the rimfire reloading tool of FIG. 1 in an open position.

With reference now to the drawings, and in particular FIGS. 1 through 9 thereof, example of the rimfire reloading tool 10. In the preferred embodiment, tool 10 produces .22 caliber heeled bullets. Directing attention to FIGS. 1-2, the rimfire reloading tool 10 includes a first lever arm 20 and a second lever arm 22. Each lever arm 20, 22 has a proximal end 24 and a distal end 26. Each lever arm 20, 22 is connected by hinge 28. In some embodiments, a heat-insulating material is placed over lever arms 20, 22, such as wooden handle grips, to prevent a user's hand from being burned when the tool 10 is heated from the molten lead used to form heeled bullets.

A first clipping portion 30, also called a "sprue cutter", is provided at the first lever arm 20 near hinge 28, and a second clipping portion 32 is provided at the second lever 22 arm near hinge 28. Each of the first and the second clipping portions 30, 32 are provided in conjunction to clip excess metal from a cast bullet. A first crimping portion 34 is provided at the first clipping portion 30, and a second crimping portion 36 is provided at the second clipping portion 32. The first crimping portion 34 and the second crimping portion 36 are provided in conjunction to crimp the metal of a rimfire bullet case to a heeled, cast bullet.

A first mold head 38 is provided at the distal end 26 of the first lever arm 20. A second mold head 40, which is a mirror image to the first mold head 38, is provided at the distal end 26 of the second lever arm 22. Each of the first mold head 38 and the second mold head 40 have an inner wall 42 and an outer wall 44. At least one concave elongated hemisphere 46 is medially provided at each of the inner walls 42, but more than one can be provided in some embodiments. The first mold head 38 and the second mold head 40 are interchangeable and provided to engage, and alternately disengage, each of the first lever arm 20 and the second lever arm 22. The distal end 26 of each lever arm 20, 22 is provided to engage with and alternately disengage from alternate mold heads 38, 40. A variety of different mold heads 38, 40 are envisioned, each having differently shaped concave elongated hemispheres 46, each mold head 38, 40 provided to engage the distal end 26 of one of the respective lever arms 20, 22 allowing for interchangeability of the mold heads 38, 40.

Figure 3:
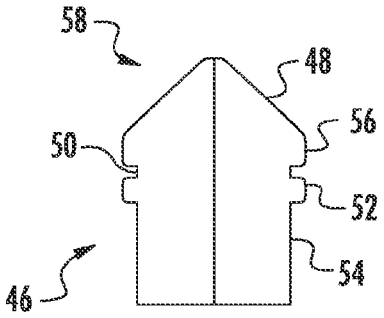
FIG. 3 is an elevation view of a bullet mold.
Figure 4:
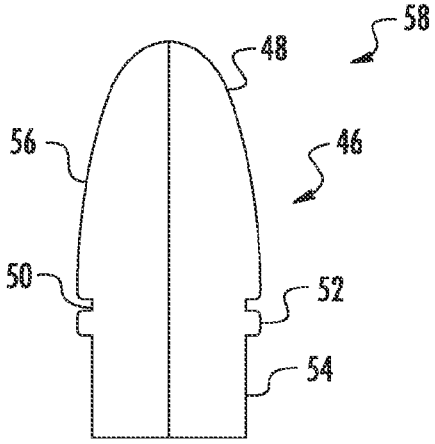
FIG. 4 is an elevation view of an alternative bullet mold

Directing attention to FIGS. 3-4, each concave elongated hemisphere 46 has a tapered tip 48, a semi-circumferential indented lip 50, a semi-circumferential raised rim 52, and a heel 54. An upper portion 56 of the tapered tip 48 has a substantially similar diameter to the raised rim 52, while indented lip 50 and heel portion 54 also have similar diameters.

Figure 5A:
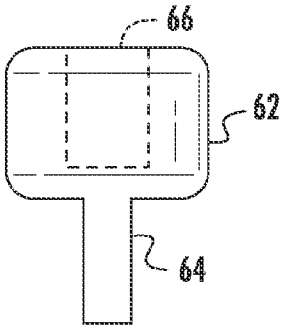
FIG. 5A is an elevation view of an embodiment of the case spinner tool.
Figure 6A:
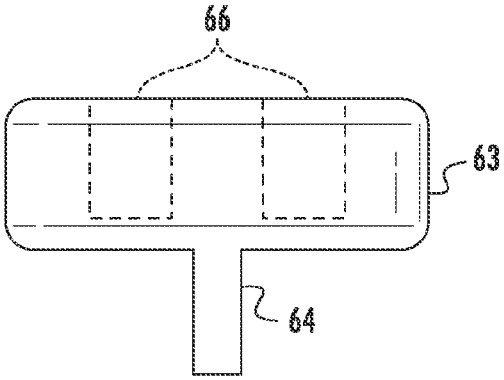
FIG. 6A is an elevation view of an alternative embodiment of the case spinner tool.
Figure 5B:
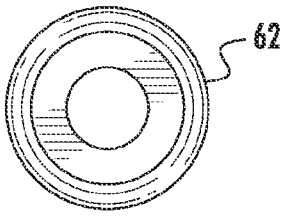
FIG. 5B is a plan view of the spinner tool of FIG. 5A.
Figure 6B:
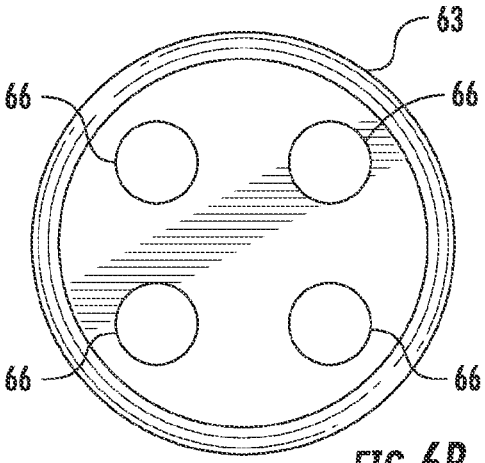
FIG. 6B is plan view of the spinner tool shown in FIG. 6A

In some embodiments, aperture 60 is provided at the proximal end 24 of lever arms 22. Aperture 60 is provided to engage a case spinner tool 62. The case spinner tool 62 has a shaft 64 and a plurality of case openings 66. Each of the case openings 66 is provided to conformingly engage a rimfire case. FIGS. 5-6 illustrate different case spinner tools 62 having a different number of case openings 66. Before loading a bullet and crimping it into a case, priming compound is placed in the case, and the case is placed in one of the case openings 66. Once inserted, the case is rotated by the user's fingers and centrifugal force distributes the priming compound on the interior surface of the case.

The art of bullet casting requires specific attention to sizes and dimensions; therefore the sizes and dimensions of the bullet mold 58 as depicted in FIGS. 3-4 are exemplary, as other sizes and dimensions are also usable with embodiments of the present invention.

The first mold head 38 and the second mold head 40 are configured to rotate about an axis of the hinge 28 flushly engaging, and alternately disengaging, the inner wall 42 of each mold head. When the inner wall 42 of each of the first mold head 38 and the second mold head 40 are flushly engaged, bullet mold profile is defined by the two concave, elongated hemispheres 46 and having heel portion 54 (FIGS. 3 and 4).

Figure 7A:
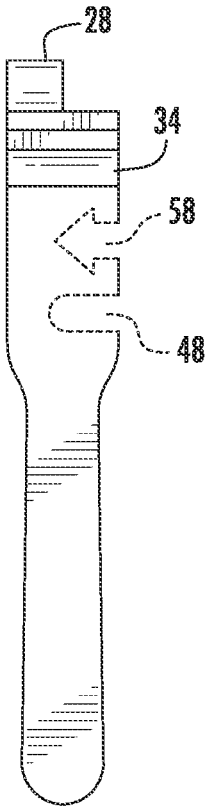
FIG. 7A is a profile view of an alternative embodiment of a rimfire reloading tool for forming multiple heeled bullets.
Figure 7B:
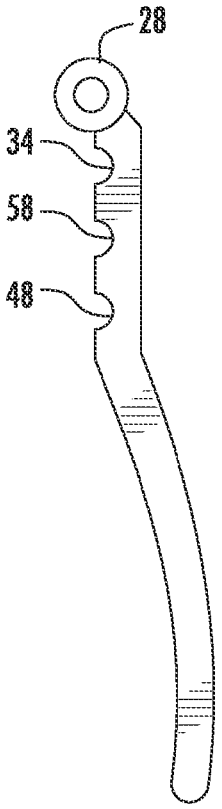
FIG. 7B is an elevation view of the rimfire reloading tool of FIG. 7A.

In some embodiments, an example of which is shown in FIGS. 7A and 7B, a plurality of concave elongated hemispheres 46 can be disposed on the inner wall 42 of each of the first mold head 38 and the second mold head 40, respectively, provided below hinge 28. When the inner walls 42 of each of the first mold head 38 and the second mold head 40 are brought into contact, a plurality of bullet molds 58 are defined by the plurality of concave elongated hemispheres 46. FIGS. 7A and 7B illustrate the concave elongated hemispheres 46 having different dimensions such that different bullet molds 58 having different dimensions are defined, producing cast bullet shapes shown in FIGS. 3-4.

The inner walls 42 of each of the first mold head 38 and the second mold head 40 are provided to align and hold an amount of molten lead within the bullet mold 58. When the molten lead cools, a cast bullet is produced with the same shape and dimensions of the concave elongated hemispheres. In some embodiments, each bullet cast is between approximately 15 grams to approximately 70 grains.

Each of the mold heads 38, 40 and lever arms 20, 22 are made of a continuously molded or welded metal, and alternately a composition of metals, such that each of the mold heads 38, 40 and lever arms 20, 22 have a melting temperature greater than 327.5 degrees Celsius. The mold heads 38, 40 and the lever arms 20, 22 can be made of a metal such as iron, brass, aluminum, steel, and the like. The mold heads 38, 40 and the lever arms 20, 22 can also be made of a composition of metal such as iron, brass, aluminum, steel and the like.

Figure 8:
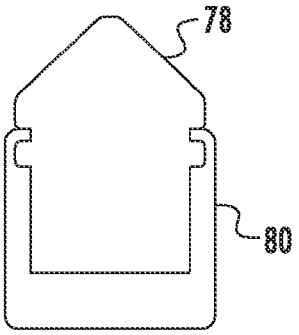
FIGS. 8 and 9 show finished cartridges, each having a bullet attached to a case.
Figure 9:
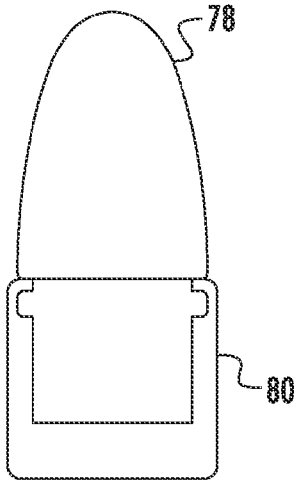

FIGS. 8-9 show finished product bullets 78 contained by crimped-on cases 80, after cases 80 are prepared with priming compound using spinner tool 60, and filled with the desired amount of gunpowder.

To use the instant bullet mold tool 10 described herein and illustrated in the drawings, the user engages the inner walls of each of the first mold head and the second mold head to align the concave elongated hemispheres of each of the mold heads. The user then pours an amount of molten lead between 15 and 70 grams into the bullet mold. After the molten lead cools and solidifies, the user disengages the inner walls of each of the first mold head and the second mold head, thereby releasing the cast bullet. The user then clips away the excess lead from the heel of the bullet using the clipping portions 30, 32 of tool 10. Finally the user crimps a rimfire case to the heel of the cast bullet using crimping portions 34, 36.

While the above discussion refers to .22 LR rimfire cases, one of average skill in the art will know that the same tool of the invention can be used with minor modification to accommodate the following alternate cases: .22 Short, .22 Long Rifle, .22 WMR, .22 MAG, .17 HM2, .17 HMR .41 rimfire, .45 rimfire, .32 rimfire.

While the preferred embodiments of a rimfire reloading tool have been illustrated and described in detail, it is to be understood that numerous modifications can be made to various embodiments without departing from the spirit of the invention.

The invention claimed is:

1. A rimfire reloading tool, comprising:

first and second handles connected by a hinge;

a bullet mold having a first mold head located on the first handle and a second bullet mold head located on the second handle that form the heeled bullet mold when brought into contact with each other;

a first clipping portion located on the first handle and a second clipping portion located on the second handle that are brought together when the first handle and second handle are in a closed position; and a first crimping portion located on the first handle and a second crimping portion located on the second handle that are brought together when the first handle and the second handle are in the closed position.

2. The rimfire reloading tool of claim 1, wherein:

the bullet mold is configured to form a .22 caliber bullet.

3. The rimfire reloading tool of claim 1, further including:

a spinner tool located in one of the first and second handles, the spinner tool having an aperture configured to receive a case containing priming compound and sufficiently dimensioned to allow the case to rotate within the aperture.

4. The rimfire reloading tool of claim 3, wherein:

the spinner tool includes a plurality of apertures configured to receive a plurality of cases containing priming compound and sufficiently dimensioned to allow the cases to rotate within the apertures.

5. The rimfire reloading tool of claim 1, wherein:

the bullet mold is formed above the hinge.

6. The rimfire reloading tool of claim 1, further including:

a plurality of bullet molds formed between the first and second handles.

7. The rimfire reloading tool of claim 6, wherein:

the plurality of bullet molds is located below the hinge.

8. The rimfire reloading tool of claim 1, wherein:

the bullet mold is dimensioned to form a raised rim on a heeled bullet on which a case is crimped.

9. The rimfire reloading tool of claim 8, wherein:

the bullet mold is dimensioned to form an indented lip and a heeled portion, the indented lip and heeled portion disposed on opposite sides of the raised rim.

10. The rimfire reloading tool of claim 1, wherein the first bullet mold head and the second bullet mold head are constructed of material that can be heated above a temperature at which lead melts while remaining rigid.

11. The rimfire reloading tool of claim 1, wherein:

the first and second handles include a heat-absorbing material.

12. A rimfire reloading hand tool, comprising:

first and second handles connected by a hinge at the top of the first and second handles;

a bullet mold having a first mold head located on the first handle and a second bullet mold head located on the second handle that form the heeled bullet mold when brought in contact with each other;

a first clipping portion located on the first handle and a second clipping portion located on the second handle that are brought together when the first handle and second handle are in a closed position; and a first crimping portion located on the first handle and a second crimping portion located on the second handle that are brought together when the first handle and the second handle are in a closed position.

13. The rimfire reloading tool of claim 12, wherein:

the bullet mold is configured to form a .22 caliber bullet.

14. The rimfire reloading tool of claim 12, further including:

a spinner tool located in one of the first and second handles, the spinner tool having an aperture configured to receive a case containing priming compound and sufficiently dimensioned to allow the case to rotate within the aperture.

15. The rimfire reloading tool of claim 14, wherein:

the spinner tool includes a plurality of apertures configured to receive a plurality of cases containing priming compound and sufficiently dimensioned to allow the cases to rotate within the apertures.

16. The rimfire reloading tool of claim 12, further including:

a plurality of bullet molds formed between the first and second handles.

17. The rimfire reloading tool of claim 12, wherein:

the bullet mold is dimensioned to form a raised rim on a heeled bullet on which a case is crimped.

18. The rimfire reloading tool of claim 12, wherein:

the bullet mold is dimensioned to form an indented lip and a heeled portion, the indented lip and heeled portion disposed on opposite sides of the raised rim.

19. A method of manufacturing a rimfire cartridge, the method comprising:

providing a hand tool having first and second handles connected by a hinge, the first handle having a first bullet mold head, a first clipping portion, and a first crimping portion;

bringing the first and second handles together to form a bullet mold;

pouring molten lead into the bullet mold;

opening the handles when the molten lead has cooled and solidified and formed a heeled bullet;

removing the heeled bullet from the bullet mold;

placing the heeled bullet in between the first clipping portion and the second clipping portion and bringing the first handle and second handle together and removing excess lead from a heeled portion of the heeled bullet; and placing the heeled portion of the heeled bullet into a case containing priming compound and gunpowder;

placing the case containing the heeled bullet in between the first crimping portion and the second crimping portion and bringing the handles together to crimp the case onto the heeled bullet, thereby providing a rimfire cartridge.

20. The method of claim 19, further including:

placing the case in a spinner tool located in the second handle and rotating it to disburse priming compound on the inner surface of the case before inserting the heeled bullet into the case.

* * * * *